US009506266B2

(12) United States Patent
Foldenauer et al.

(10) Patent No.: US 9,506,266 B2
(45) Date of Patent: Nov. 29, 2016

(54) CONCRETE DECK WITH LATERAL FORCE RESISTING SYSTEM

(71) Applicant: Aditazz, Inc., Brisbane, CA (US)

(72) Inventors: Donald J. Foldenauer, San Jose, CA (US); Ehab Hamouda, San Francisco, CA (US); Sungmin Kim, Morgan Hill, CA (US); Mark Moore, Richmond, CA (US); Nicholas Reid, San Francisco, CA (US); Zigmund Rubel, Greenbrae, CA (US)

(73) Assignee: ADITAZZ, INC., Brisbane, CA (US)

( * ) Notice: Subject to any disclaimer, the term of this patent is extended or adjusted under 35 U.S.C. 154(b) by 0 days.

(21) Appl. No.: 14/878,420

(22) Filed: Oct. 8, 2015

(65) Prior Publication Data

US 2016/0076269 A1 Mar. 17, 2016

Related U.S. Application Data

(63) Continuation-in-part of application No. 14/484,051, filed on Sep. 11, 2014.

(60) Provisional application No. 62/061,285, filed on Oct. 8, 2014.

(51) Int. Cl.
*E04H 12/16* (2006.01)
*E04B 1/348* (2006.01)
(Continued)

(52) U.S. Cl.
CPC ..... *E04H 12/16* (2013.01); *E04B 1/3483* (2013.01); *E04B 5/04* (2013.01); *E04B 5/14* (2013.01);
(Continued)

(58) Field of Classification Search
CPC ..... E04B 1/41; E04B 1/4107; E04B 1/4114; E04B 1/40; E04B 1/4157; E04B 1/4121; E04B 1/4128; E04B 1/4135; E04B 1/4142; E04B 1/4164; E04B 1/04; E04B 1/043; E04B 1/046; E04B 2001/2454; E04B 2001/2424; E04B 2001/2441; E04B 2001/2484; E04B 5/04; E04B 5/14; E04B 5/48; E04C 2/06; E04C 5/02; E04C 5/04; E04C 5/16; F16L 5/04; F16L 5/00; F16L 5/10; H02G 3/22
USPC ..... 52/220.3, 220.4, 220.8, 250, 583.1, 52/336, 125.5, 587.1, 586.1, 582.1
See application file for complete search history.

(56) References Cited

U.S. PATENT DOCUMENTS 938,458 A 11/1909 Brockhausen
1,061,665 A 5/1913 Easterday
(Continued)

FOREIGN PATENT DOCUMENTS

WO 9733788 A1 9/1997

OTHER PUBLICATIONS

International Search Report, PCT/US2015/054685, Dec. 29, 2015.
(Continued)

*Primary Examiner* — Rodney Mintz

(57) ABSTRACT

Embodiments of a deck assembly module for a steel framed building include a modular concrete deck platform. The modular concrete deck platform includes a concrete slab having a top major surface and a bottom major surface and a structural grid pattern of reinforcing bar within the concrete slab. The concrete slab further includes sleeve openings located around a perimeter of the concrete slab, the sleeve openings surrounded by sleeve structures, the sleeve structures surrounded by concrete. Each sleeve opening extends from the top major surface of the concrete slab to the bottom major surface of the concrete slab.

8 Claims, 14 Drawing Sheets

(51) Int. Cl.

| | |
|---|---|
| ***E04H 12/14*** | (2006.01) |
| ***E04H 12/34*** | (2006.01) |
| ***E04H 1/04*** | (2006.01) |
| ***E04B 5/04*** | (2006.01) |
| ***E04B 5/14*** | (2006.01) |
| ***E04C 2/06*** | (2006.01) |
| ***E04C 5/04*** | (2006.01) |
| ***E04C 5/16*** | (2006.01) |
| *E04B 1/24* | (2006.01) |

(52) U.S. Cl.

CPC . *E04C 2/06* (2013.01); *E04C 5/04* (2013.01); *E04C 5/16* (2013.01); *E04H 1/04* (2013.01); *E04H 12/14* (2013.01); *E04H 12/34* (2013.01); *E04B 1/24* (2013.01); *E04B 2001/2424* (2013.01); *E04B 2001/2442* (2013.01); *E04B 2001/2454* (2013.01); *E04B 2001/2484* (2013.01)

(56) References Cited

U.S. PATENT DOCUMENTS 1,319,731 A 10/1919 Stuverud
1,523,811 A * 1/1925 Lichtenberg ..... E04C 2/06 52/442
1,624,802 A 4/1927 Rebell
1,912,290 A * 5/1933 Marks ..... E04B 5/04 52/432
2,137,009 A * 11/1938 Stromberg ..... E04B 5/14 52/220.3
2,215,975 A * 9/1940 Rackle ..... E04B 5/04 52/440
2,780,150 A 2/1957 Yeoman
3,029,561 A 4/1962 Clay
3,429,092 A * 2/1969 Hart ..... E04B 1/20 52/236.7
3,832,817 A * 9/1974 Martens ..... E04C 2/06 52/259
3,842,562 A 10/1974 Daigle
4,037,375 A 7/1977 Maggos et al.
4,080,765 A * 3/1978 Fasano ..... E04B 1/06 403/153
4,120,131 A * 10/1978 Carroll ..... E04B 1/164 52/310
4,144,369 A 3/1979 Wass
4,285,173 A * 8/1981 Grearson ..... E04B 5/40 52/250
4,300,320 A 11/1981 Rooney
4,330,970 A 5/1982 Bonink
4,800,697 A 1/1989 Oswald
4,972,537 A 11/1990 Slaw, Sr.
5,113,625 A 5/1992 Davis
5,216,860 A * 6/1993 Thomson ..... E04B 1/043 52/259
5,396,747 A 3/1995 Breuning
5,399,050 A 3/1995 Jacobus
5,425,214 A 6/1995 Truelove et al.
5,642,968 A 7/1997 Anderson et al.
5,671,582 A 9/1997 Reay
5,678,372 A 10/1997 Thomson et al.
5,758,467 A 6/1998 Snear et al.
5,806,273 A * 9/1998 Kaminski ..... E04B 5/04 404/41
5,809,712 A 9/1998 Simanjuntak
5,953,864 A * 9/1999 Beck ..... E04B 1/0007 403/DIG. 12
6,178,710 B1 1/2001 Colalillo
6,308,478 B1 10/2001 Kintscher et al.
6,467,223 B1 10/2002 Christley
6,484,471 B2 11/2002 Steed et al.
6,568,139 B2 * 5/2003 Bot ..... E01D 19/125 52/125.5
6,793,436 B1 * 9/2004 Ruel ..... E02D 29/0241 403/208
6,804,923 B1 10/2004 Potter
6,857,241 B1 2/2005 Pellicer
7,281,356 B2 * 10/2007 Sanftleben ..... E04G 15/061 248/68.1
7,963,073 B1 * 6/2011 Pellegrene ..... E04B 1/34823 109/83
8,245,469 B2 * 8/2012 Rubel ..... E04B 1/24 52/223.6
8,448,280 B2 * 5/2013 Aumuller ..... E01D 2/02 14/77.1
8,840,341 B2 9/2014 Nelson et al.
2004/0060249 A1 * 4/2004 Sanftleben ..... E04G 15/061 52/220.8
2006/0179750 A1 * 8/2006 Patrick ..... E04B 5/40 52/309.16
2007/0000077 A1 1/2007 Wilson
2007/0101675 A1 5/2007 Veerman et al.
2008/0010943 A1 1/2008 Marschke
2008/0083181 A1 4/2008 Ospina
2008/0295433 A1 12/2008 Eyal et al.
2009/0057486 A1 3/2009 Becht, IV et al.
2009/0188193 A1 7/2009 Studebaker et al.
2009/0266010 A1 10/2009 Lomske et al.
2009/0272067 A1 11/2009 Gilham
2009/0308005 A1 * 12/2009 Ireland ..... E04B 1/41 52/250
2010/0101160 A1 * 4/2010 Bongiorno ..... E04C 5/02 52/167.1
2011/0131905 A1 * 6/2011 Aumuller ..... B28B 1/0873 52/223.6
2011/0283643 A1 * 11/2011 Rubel ..... E04B 1/24 52/327
2012/0233945 A1 9/2012 Rubel
2014/0202795 A1 * 7/2014 Simmons ..... E04G 5/144 182/129
2015/0013255 A1 * 1/2015 Hunt ..... E04B 1/20 52/236.3
2015/0068138 A1 * 3/2015 Rubel ..... E04C 5/04 52/98
2016/0251853 A1 * 9/2016 Rubel ..... E04B 5/10

OTHER PUBLICATIONS

International Search Report & Written Opinion, PCT/US2014/055236, Dec. 24, 2014.

* cited by examiner

CONCRETE DECK WITH LATERAL FORCE RESISTING SYSTEM

CROSS-REFERENCE TO RELATED APPLICATION

This application is entitled to the benefit of provisional U.S. Patent Application Ser. No. 62/061,285, filed Oct. 8, 2014, entitled "Concrete Deck with Lateral Force Resisting System," which is incorporated by reference herein. This application is also a Continuation-In-Part of U.S. patent application Ser. No. 14/484,051, filed Sep. 11, 2014, entitled "Concrete Deck for an Integrated Building System Assembly Platform," which is incorporated by reference herein.

FIELD OF THE INVENTION

The invention relates generally to structural framed buildings, and, more specifically to modular components for structural framed buildings.

BACKGROUND

Structurally framed buildings generally include a steel or concrete frame of columns, girders, and beams that support concrete decks. The construction of steel framed building floors and platforms are assembled onsite without any aggregation of components into modules prior to arriving on the building site. Concrete floors are poured onsite at each building under construction. Onsite pouring of concrete is laden with variability and problems compared to a factory controlled mix and setting of concrete. Many factors affect the life, strength, and overall quality of concrete, including weather conditions at the time of installation and the quality of skilled labor.

SUMMARY

Embodiments of a deck assembly module for a steel framed building are disclosed. In an embodiment, a deck assembly module includes a modular concrete deck platform. The modular concrete deck platform includes a concrete slab having a top major surface and a bottom major surface and a structural grid pattern of reinforcing bar within the concrete slab. The concrete slab further includes sleeve openings located around a perimeter of the concrete slab, the sleeve openings surrounded by sleeve structures, the sleeve structures surrounded by concrete. Each sleeve opening extends from the top major surface of the concrete slab to the bottom major surface of the concrete slab.

Embodiments of a steel framed building are disclosed. In an embodiment, a steel framed building includes a structural frame defining a footprint of the steel framed building, the structural frame including vertical columns and horizontal beams and girders. The horizontal beams and girders define bays within the steel framed building. The steel framed building further includes modular concrete deck platforms located on the horizontal beams and girders of the structural frame. The modular concrete deck platforms include a concrete slab having a top major surface and a bottom major surface and a structural grid pattern of reinforcing bar within the concrete slab. The modular concrete deck platforms further include sleeve openings located at a perimeter of the top major surface of the concrete slab, the sleeve openings surrounded by sleeve structures and the sleeve structures surrounded by concrete. Each sleeve opening extends from the top major surface of the concrete slab to the bottom major surface of the concrete slab.

Embodiments of a method for constructing a floor in a steel framed building are disclosed. In an embodiment, the method includes placing a modular concrete deck platform on horizontal beams and girders of a steel framed building, the modular concrete deck platform having a perimeter shape that corresponds to dimensions of a bay of the steel framed building, and the beams and girders outline the perimeter of the bay. According to the method, placing the modular concrete deck platform involves placing perimeter edges of a bottom surface of the modular concrete deck platform on a portion of a top surface of the beams and girders. The sleeve openings that extend from a top major surface of the modular concrete deck platform to a bottom major surface of the modular concrete deck platform expose a portion of the top surface of the beams and girders. After placing the modular concrete deck platform, the method involves attaching shear connectors to the horizontal beams and girders of the steel framed building in the exposed portion of the top surface of the beams and girders and within the sleeve openings.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements. Additionally, in some cases, reference numbers are not repeated in each figure in order to preserve the clarity and avoid cluttering of the figures.

DETAILED DESCRIPTION

Figure 1:
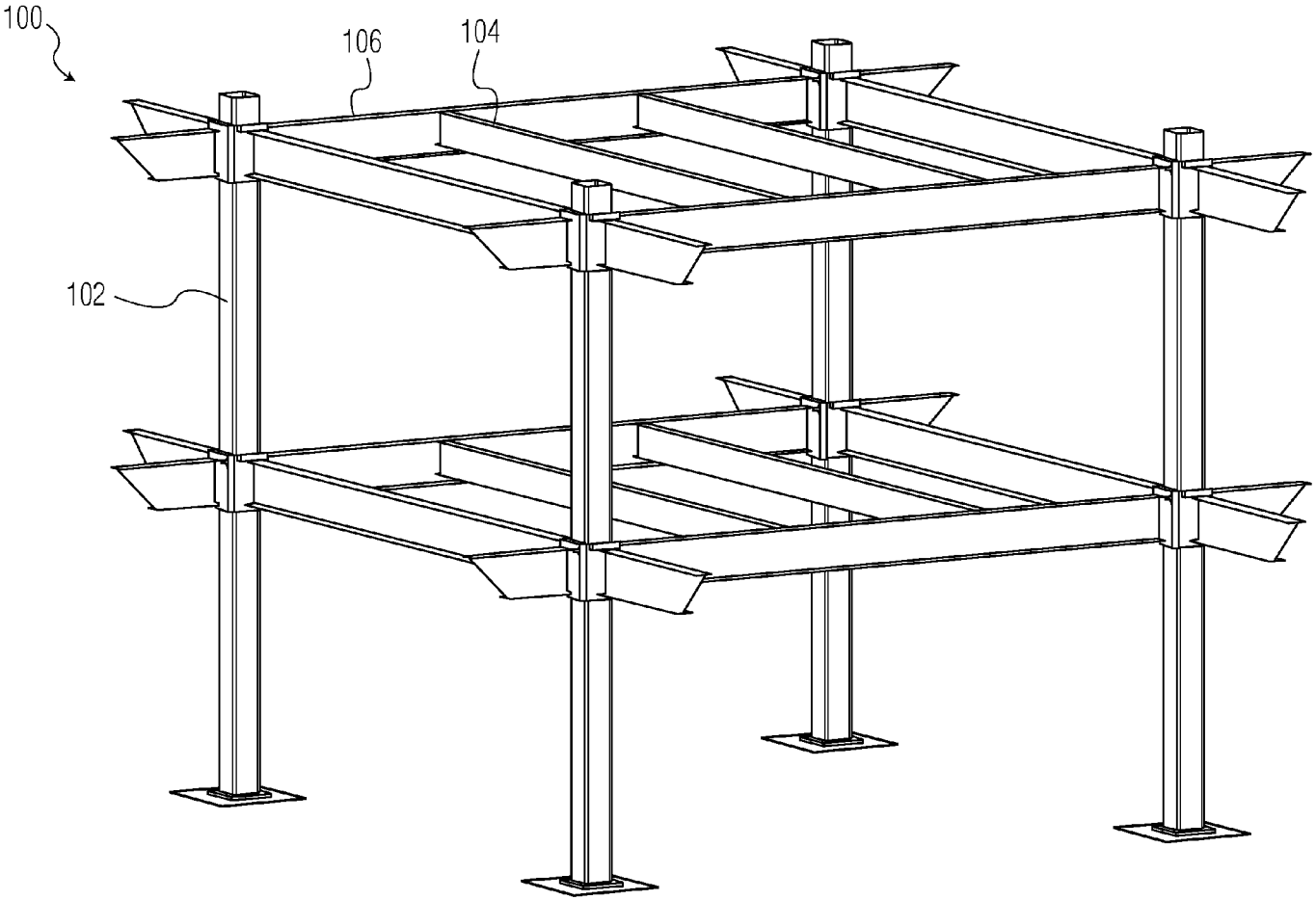
FIG. 1 depicts a perspective view of one embodiment of a structural frame of a framed building.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated. In addition, the drawing shapes are illustrative only unless specifically indicated.

The described embodiments are to be considered in all respects only as illustrative and not restrictive as to size, proportion, or specific arrangement of elements. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

While many embodiments are described herein, at least some of the described embodiments allow for the resistance to shearing forces between a modular concrete deck platform and the beams and girders upon which the platform sits. The resistance to shearing forces allows for modular concrete deck platforms to be placed on a framed building and for shear connectors to interface with sleeve openings and resist shearing. Embodiments allow for the fabrication of modular concrete deck platforms that can resist shearing forces that may occur naturally or due to events (seismic or otherwise). Some embodiments allow for fabrication of modular concrete deck platforms at a central facility before being transported to a building site for placement on a steel frame of a building. The modular concrete deck platforms may be fabricated in a facility allowing for more optimal control of the curing of the concrete to better meet building requirements. The modular concrete deck platforms may be fabricated to the standard size of bays of a steel frame building. The modular concrete deck platforms may have sleeve openings located near the perimeter of the modular concrete deck platforms. The platforms may be placed on the steel frame with the openings exposing the beam on which the platforms are placed. Shear connectors may then be attached to the beams within the sleeve openings. The openings and any gaps between the platforms may then be filled with a grout material to create a seamless floor for the building.

Some embodiments allow for better quality control as platforms may be fabricated at a central site. Greater quality control allows for potential reduced overall weight of the platforms without sacrificing design requirements. Some embodiments allow for rapid connection of platforms to a steel frame. The crew would not need to wait for concrete floors to set before proceeding to fabricate the next floor. Buildings utilizing embodiments described herein may be erected significantly faster as platforms will have already been fabricated.

Some embodiments allow for savings in fireproofing material and time. Embodiments allow for reduction of fire proofing material (as well as the labor time to apply it) during the fireproofing of a steel frame building. Fireproofing material is sprayed on metal decks to meet building codes because metal is highly thermally conductive. Building codes require fireproofing to be over-sprayed by at least 12" when thermally conductive material touches a structural steel frame. The use of concrete decks eliminates costly fireproofing material.

FIG. 1 depicts a plan view of one embodiment of a structural frame 100 of a framed building. The structural frame 100 may include columns 102—which are generally vertical to the surface on which the building sits—and girders 104 and other support beams 106, which are generally horizontal to the surface on which the building sits. Structural frames 100 and framed buildings are well known in the field.

In one embodiment, the structural frames 100 are steel frames. In one embodiment, the columns 102 are "I" shaped steel beams, referred to as "I-beams". In general, the I-beams may be spaced apart in a grid structure to create varying sizes of buildings. Other types, shapes, or materials may be used for the structural frames 100 used for framing the framed building. The material for the framed building may include a composite of more than one material.

The spacing of the girders 104 may be determined by the spacing of the columns 102. The spacing of the beams 106 may be more flexible than the spacing of the girders 104. The beams 106 may be located between pairs of columns 102, and additional beams 106 may be located between columns 102.

Figure 2A:
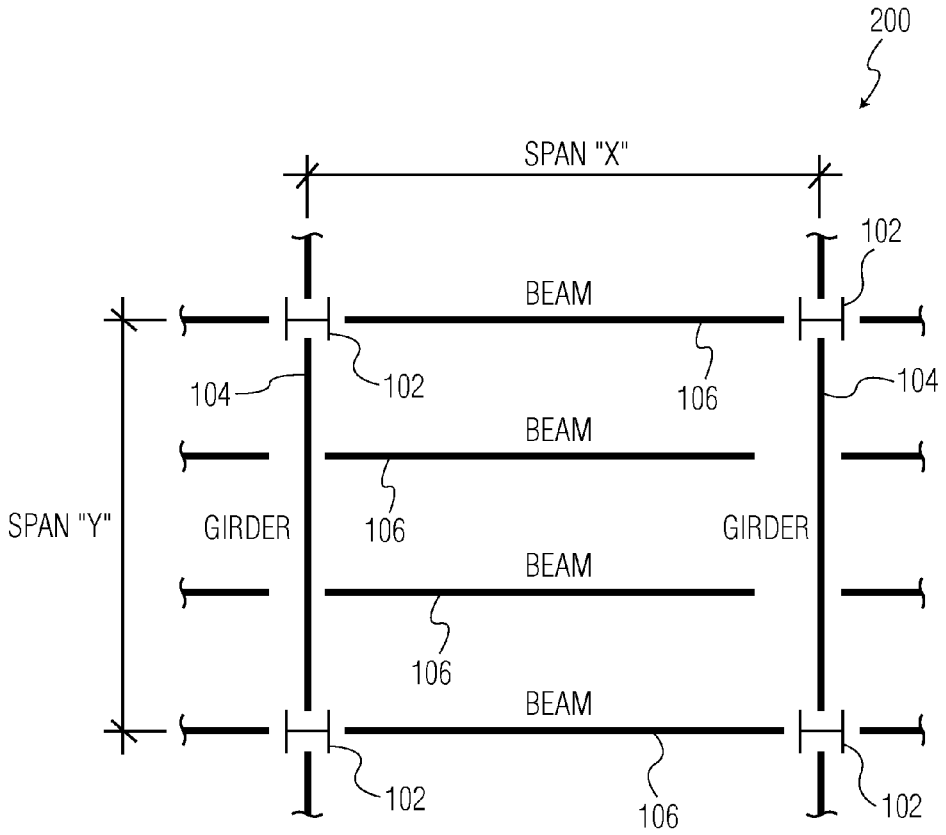
FIG. 2A depicts a plan view of an embodiment of a steel frame of a steel framed building.

FIG. 2A depicts a plan view of an embodiment of a steel frame 200 of a steel framed building. The steel frame includes support columns 102, which are generally vertical to the surface on which the building sits, and girders 104 and beams 106, which are generally horizontal to the surface on which the building sits.

In the embodiment of FIG. 2A, the columns 102 are "I" shaped steel beams, referred to as "I-beams." In general, the I-beams are spaced apart in a grid structure that includes an X-span dimension and a Y-span dimension. For example, X and Y spans in the range of 10-70 feet are known and X and Y spans in the range of 20-40 feet are common. Additionally, other dimensions are possible. Although I-beams are described as one type of steel column, other types and/or shapes of steel columns are possible. Further, the columns may be made out of other materials and/or a composite of steel and at least one other material.

In the embodiment of FIG. 2A, the girders 104 and beams 106 are "I" shaped steel beams, sometimes referred to as "W sections." Typically, the girders connect to the columns in one direction and the beams connect between the girders and the columns 102 in a direction that is perpendicular to the girders. Although the girders and beams have been described as I-beams, in alternative embodiments, the girders and beams may include, for example, rectangular tubes, tees, angled shaped pieces, and zee shaped pieces.

Figure 2B:
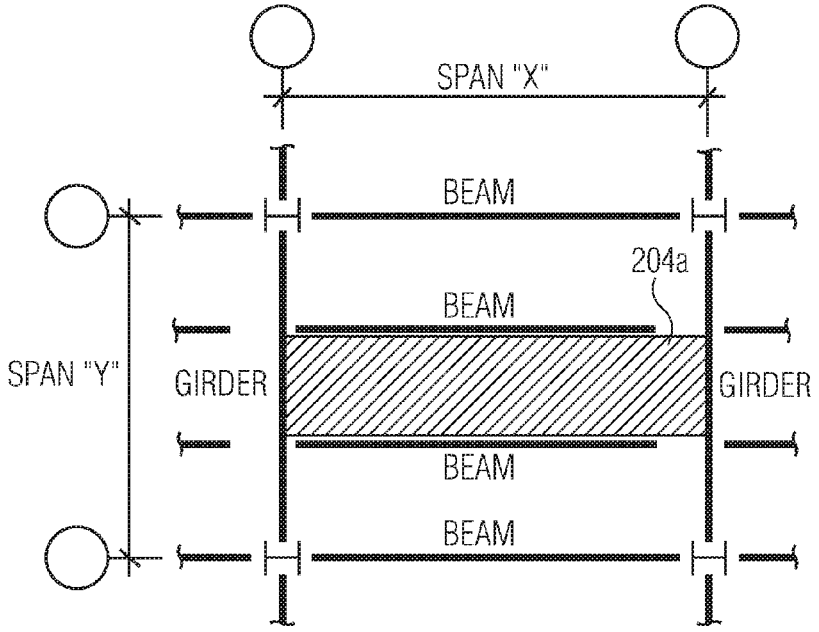
FIG. 2B highlights a mid-bay in the embodiment of the steel frame of FIG. 2B.
Figure 2C:
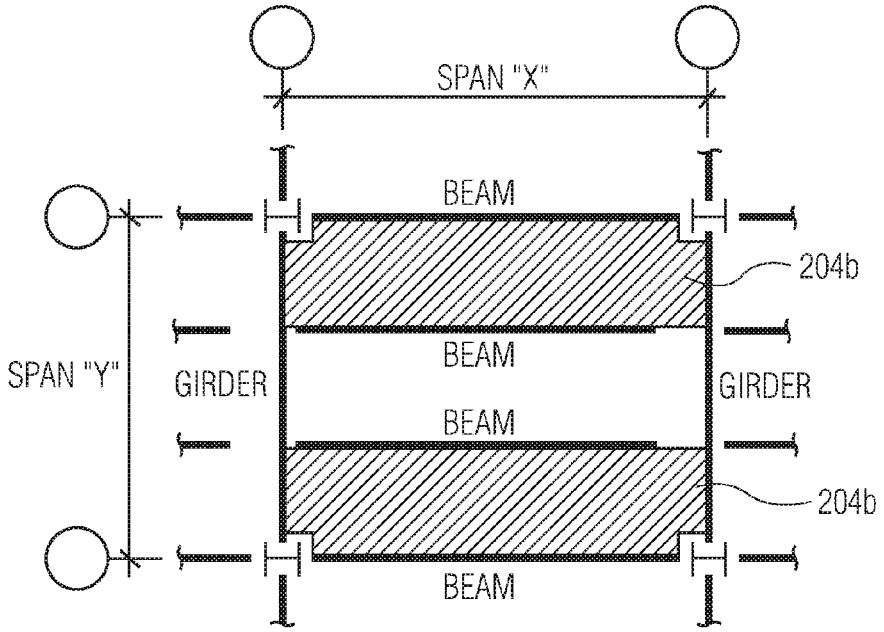
FIG. 2C highlights two end-bays in the embodiment of the steel frame of FIG. 2A.

The spacing of the girders 104 is dictated by the spacing of the columns 102. The spacing of the beams 106 is more flexible. In an embodiment, beams 106 are located between pairs of columns 102 and additional beams 106 are located between columns 102. In an embodiment, beams are spaced apart by about 10 feet, although other spacing is possible. As will be described below, the spacing of the columns, girders, and beams forms "bays," where a bay is generally defined as the area bordered by a pair of parallel girders and a pair of parallel beams. The dimensions of the bays may be the same from bay-to-bay or may vary depending on the building. In an embodiment, some of the bays in a building have similar dimensions while other bays of the building have dimensions that are customized to correspond to specific features of the building. As is described below, the deck assembly modules are sized such that a deck assembly module fills a bay. The shape of a bay may vary depending on whether the bay is a mid-bay or an end-bay, where a mid-bay is bordered by girders and beams but does not include any column connection points and an end-bay includes at least one column connection point. FIG. 2B highlights a mid-bay 204*a* in the steel frame 200 of FIG. 2A. As shown in FIG. 2B, the mid-bay 204*a* does not have any sides or corners that are formed by a column 102. FIG. 2C highlights two end-bays 204*b* in the steel frame 200 of FIG. 2A. As shown in FIG. 2C, the two end-bays 204*b* have two corners of the bays 204*b* that are at least partially formed by a column 102. The existence of the columns 102 at the corners of the bays 204*b* changes the shape of the end-bays 204*b*. In an embodiment, deck assembly modules that are intended for end-bays 204*b* are configured to cope around the columns 102 of the steel frame 200. Additionally, the shape of the deck assembly modules will depend on which side of the deck assembly module abuts to the columns 102. In some embodiments, a steel framed building may not include a column at four points of a bay as depicted in FIGS. 2A-2C. For example, a steel framed building may not include a column 102 at a perimeter location of the steel framed building or at a cantilevered floor. In these cases, it is possible to have a deck assembly module that has coping to accommodate only one column 102. Additionally, it is possible to have a deck assembly module that has coping to accommodate more than two columns 102 or features other than columns 102.

In an embodiment, each deck assembly module is configured to have a shape that corresponds to the shape of the bays 204 that are formed by the steel frame 200. For example, deck assembly modules intended for the mid-bays 204*a* are shaped to correspond to the shape of the mid-bays 204*a* and deck assembly modules intended for the end-bays 204*b* are shaped to correspond to the shape of the end-bays 204*b*. Additionally, deck assembly modules that are intended for end-bays 204*b* are shaped to correspond to the particular location of the columns 102. For example, the two corners of a deck assembly module that will abut to a column 102 are dependent on the location of the deck assembly module relative to the columns 102. With reference to FIG. 2C, the upper end-bay needs a deck assembly module that has coped corners at the upper right and upper left corners and the lower end-bay needs a deck assembly module that has coped corners at the lower right and lower left corners. The size and shape of the deck assembly module can be set to correspond to various different sizes and configurations of steel frames. For example, the deck assembly modules can be designed to accommodate other sizes and configurations of girders 104 and/or beams 106. In an embodiment, the deck assembly module is configured to cooperate with commonly used structural configurations, such as circular or rectangular tubes, channels, angles, tees, and/or zee shaped pieces.

In an embodiment, the exact size and shape of the deck assembly module may be governed in part by at least one of the following parameters: structural performance requirements of the steel frame 200; structural requirements per regulatory requirements or design codes; the framing geometry of the steel frame 200; transportation requirements of the jurisdictions in which the deck assembly module is transported on public roads; and vehicle availability for transport. In an embodiment, the deck assembly module is designed with a 10'-0" maximum width dimension and a fifty foot maximum length dimension so that the deck assembly module can be transported as one piece on public roads using conventional transportation means. In another embodiment, the deck assembly module is designed with a 15'-0" maximum width dimension and a fifty foot maximum length dimension, although it should be understood that other dimensions are possible.

Other building design requirements may affect the size and shape of deck assembly modules, as well as the materials used. Appropriately sized reinforcing bar (or rebar) and other materials and additives may be dictated by the specific use of a building. The deck assembly modules may be designed for a range of vertical gravity loads, to deflect no more than required under dead and live loading values, to limit cracking to structurally acceptable values, to achieve an appropriate fire rating, and to appropriately cover various shaped bays in a framed building. Other deck assembly modules may be designed such that they can be tiled or patterned in different configurations over the plan of a building. The shear force in deck assembly modules may be influenced by many factors, including but not limited to, seismic design category, soil category, the lateral system, building height, and building weight.

While the majority of steel framed buildings use orthogonal geometry for framing, the deck assembly modules may be fabricated to other polygonal and/or curvilinear shapes to correspond to the structural framing of a building.

Figure 3:
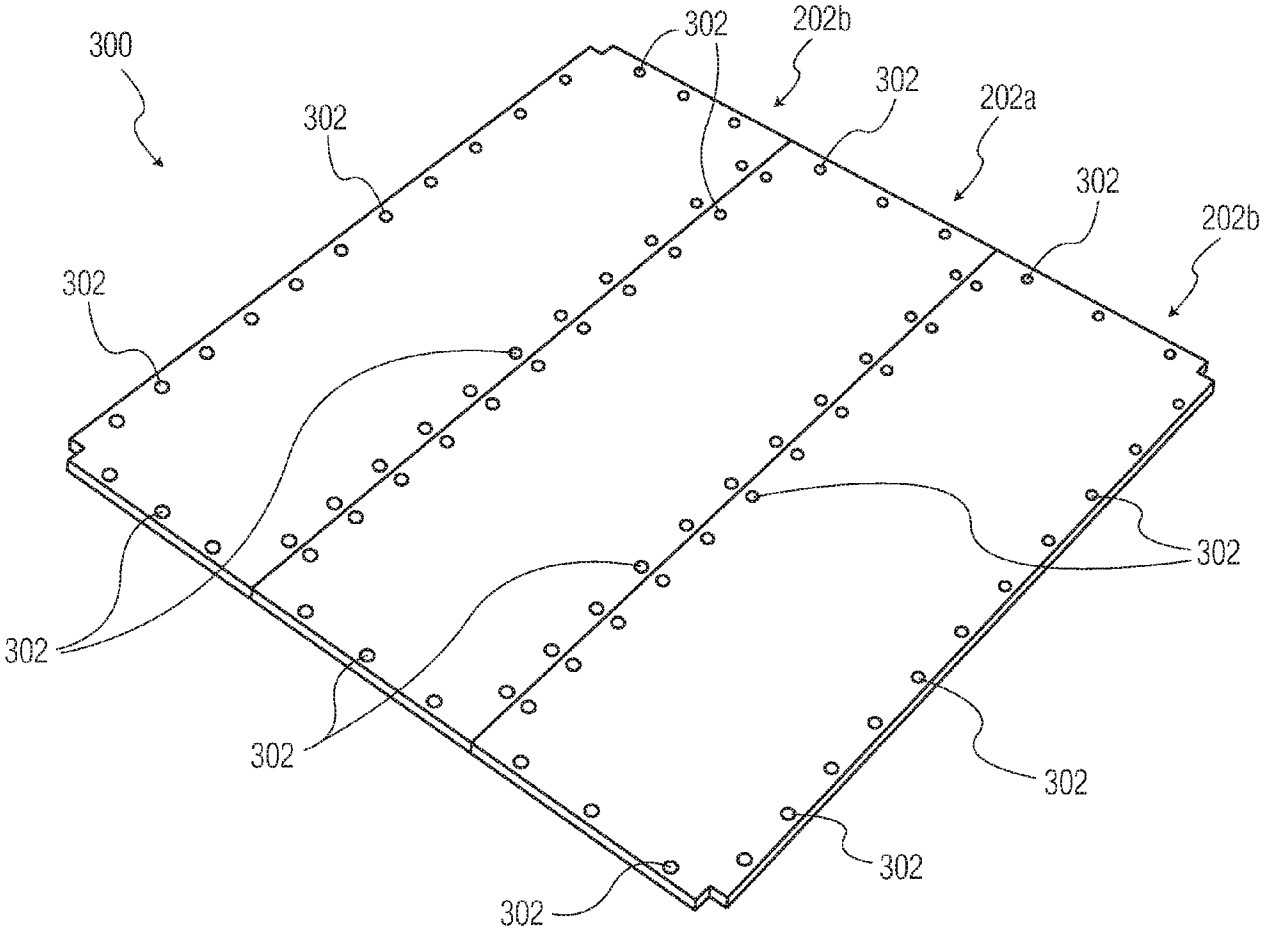
FIG. 3 depicts an embodiment of three modular concrete deck platforms side by side.

FIG. 3 depicts an embodiment of three modular concrete deck platforms 202*a* and 202*b* side by side. In the illustrated embodiment, the three modular concrete deck platforms 202*a*-202*b* would correspond to bays 204*a*-204*b*. The center modular concrete deck platform 304*a* corresponds to bay 204*a*, and the modular concrete deck platforms 202*b* correspond to bay 204*b*. As illustrated, the two end modular concrete deck platforms 202*b* are shaped to correspond to the particular location of columns 102 of a building. For example, the two corners of the modular concrete deck platforms 202*b* that will abut to a column 102 are shaped to allow placement of the modular concrete deck platforms

202*b* next to a column 102. The shape may vary to correspond directly to other shaped columns that may be present in a building. In some embodiments, the modular concrete deck platforms 202 will be shaped principally like the shape of bays 204. In the illustrated embodiment, the shape of the modular concrete deck platforms 202 is principally rectangular. The end modular concrete deck platforms 202*b* have corner notches that correspond to the placement of the modular concrete deck platforms 202*b* in relation to columns 102. The center modular concrete deck platform 202*a* does not have corner notches. The location of such polygonal and/or curvilinear notches is dependent on the location of the modular concrete deck platform 202 relative to the columns 102. The location may be along a side of a modular concrete deck platform 202 instead of a corner of the modular concrete deck platform 202.

The illustrated embodiment further depicts sleeve openings 302. The illustrated sleeve openings 302 are depicted on the edge portion of the top major surface of the modular concrete deck platform 202. The sleeve openings 302 are openings that extend from the top major surface to the bottom major surface of the concrete slab of the modular concrete deck platform 202. The sleeve openings 302 allow access to the beams 106 and girders 104 of the structural frame of a building. The access allows for the modular concrete deck platforms 202 to be attached to the structural frame of the building. As such, the location of the sleeve openings 302 is near where the modular concrete deck platform 202 rests on the beams 106 and/or girders 104. Once a modular concrete deck platform 202 is placed on the structural frame of a building, the modular concrete deck platform 202 is secured in place through the access provided by the sleeve openings 302. In some embodiments, the sleeve openings 302 are located near a perimeter side of the modular concrete deck platform 202 to allow the concrete deck platform to be secured to the structural frame of the building. In some embodiments, the sleeve openings 302 are located around the perimeter of the modular concrete deck platform 202 near each side of the modular concrete deck 202. The illustrated sleeve openings 302 are round but are not limited to a particular shape. The sleeve openings 302 may be of other shapes that would allow access to a structural frame of a building.

The modular concrete deck platforms 202 are formed into a concrete slab. Within the concrete slab is reinforcing bar (not shown). In the illustrated embodiment, each modular concrete deck platform 202 has multiple sleeve openings 302 spaced along the perimeter of the modular concrete deck platform 202. The sleeve openings 302 may allow for access to the beams 106 and girders 104 of a building frame through the modular concrete deck platforms 202. In some embodiments, the sleeve openings 302 may be spaced evenly in standardized increments along the perimeter of a modular concrete deck platform 202. In some embodiments, the sleeve openings 302 may be staggered in uneven increments. Some embodiments may have more or less sleeve openings 302 than are illustrated in FIG. 3 to respond to the structural force transfer required from the concrete deck platform to the structural frame of the building. For example, in some embodiments, there may be only one sleeve opening 302 on each principal side of a modular concrete deck platform 202. In other embodiments, each principal side may have more than one sleeve opening 302. The number and location of sleeve openings 302 may vary depending on the design requirements of a particular building or other considerations. Optimal distribution of sleeve openings is based on distributing the sleeve openings around the perimeter of the concrete deck platform in a sufficient number to accommodate structural force transfer requirements of the concrete deck platform to the structural frame of the building. In some embodiments, each sleeve opening 302 will interface with shear connectors (described more fully below). Each sleeve opening 302 may interface with as few as one shear connector or as many as needed to transfer the forces from the platform 202 to the structural frame.

The sleeve openings 302 are openings within the concrete slab. The concrete slab is fabricated so that the sides of the modular concrete deck platform 202 align with the geometry of bays 204 of a building. The sleeve openings 302 are openings within the concrete slab that allow for access to a beam 106 or girder 104 via the sleeve openings 302 after setting a modular concrete deck platform 202 in place. The illustrated embodiment of FIG. 3 shows the modular concrete deck platforms 202 as they would be placed next to each other on the beams 106 and girders 104. As shown, even when the modular concrete deck platforms 202 are placed, the sleeve openings 302 allow for access of the modular concrete deck platform 202 to the beams 106 and girders 104 of the building. Sleeve openings 302 may be of other shapes, sizes, or geometries. In the illustrated embodiment, the sleeve openings 302 are cylindrical. In the illustrated embodiment, the sleeve opening 302 is a circular shape that extends from a top major surface of the concrete slab to a bottom major surface (not visible) of the concrete slab.

Figure 4A:
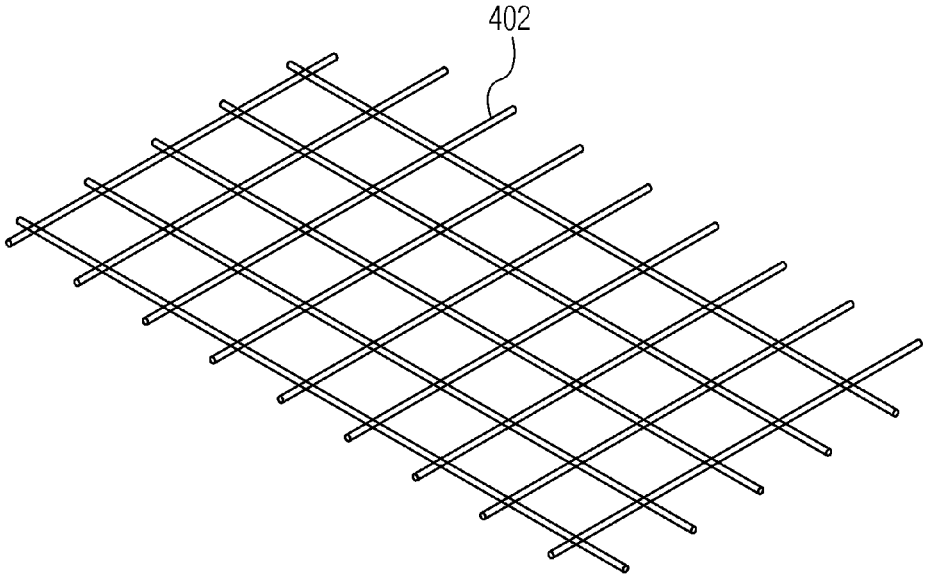
FIG. 4A depicts an embodiment of a structural grid pattern of reinforcing bar.
Figure 4B:
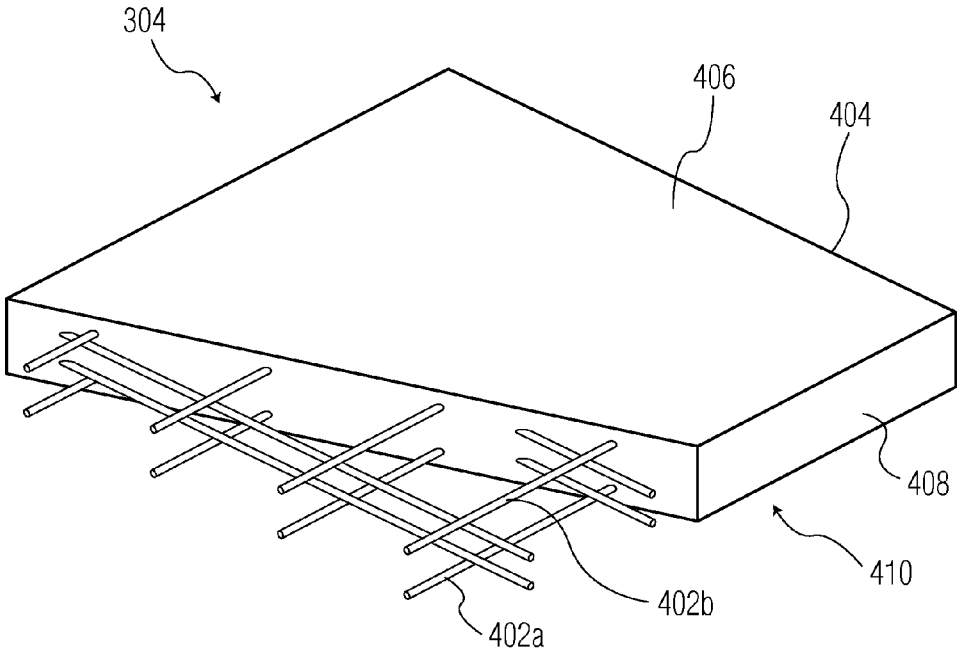
FIG. 4B depicts a cut-away view of an embodiment of a concrete slab including a structural grid pattern of reinforcing bar within the concrete slab.

FIG. 4A depicts an embodiment of a structural grid pattern of reinforcing bar 402. The reinforcing bar 402 may be placed in various patterns to best strengthen and reinforce the concrete slab. FIG. 4B depicts a cut-away view of an embodiment of a concrete slab 404 including a structural grid pattern of reinforcing bar 402*a*-402*b* within the concrete slab 404. The concrete slab 404 is formed around the reinforcing bar 402*a*-402*b*. The illustrated embodiment depicts a lower grid 402*a* and an upper grid 402*b*. Other configurations of reinforcing bar 402 are possible depending on the size and thickness of the concrete slab 404. The concrete slab 404 shows a top major surface 406 while the bottom major surface 410 is not visible.

Figure 5:
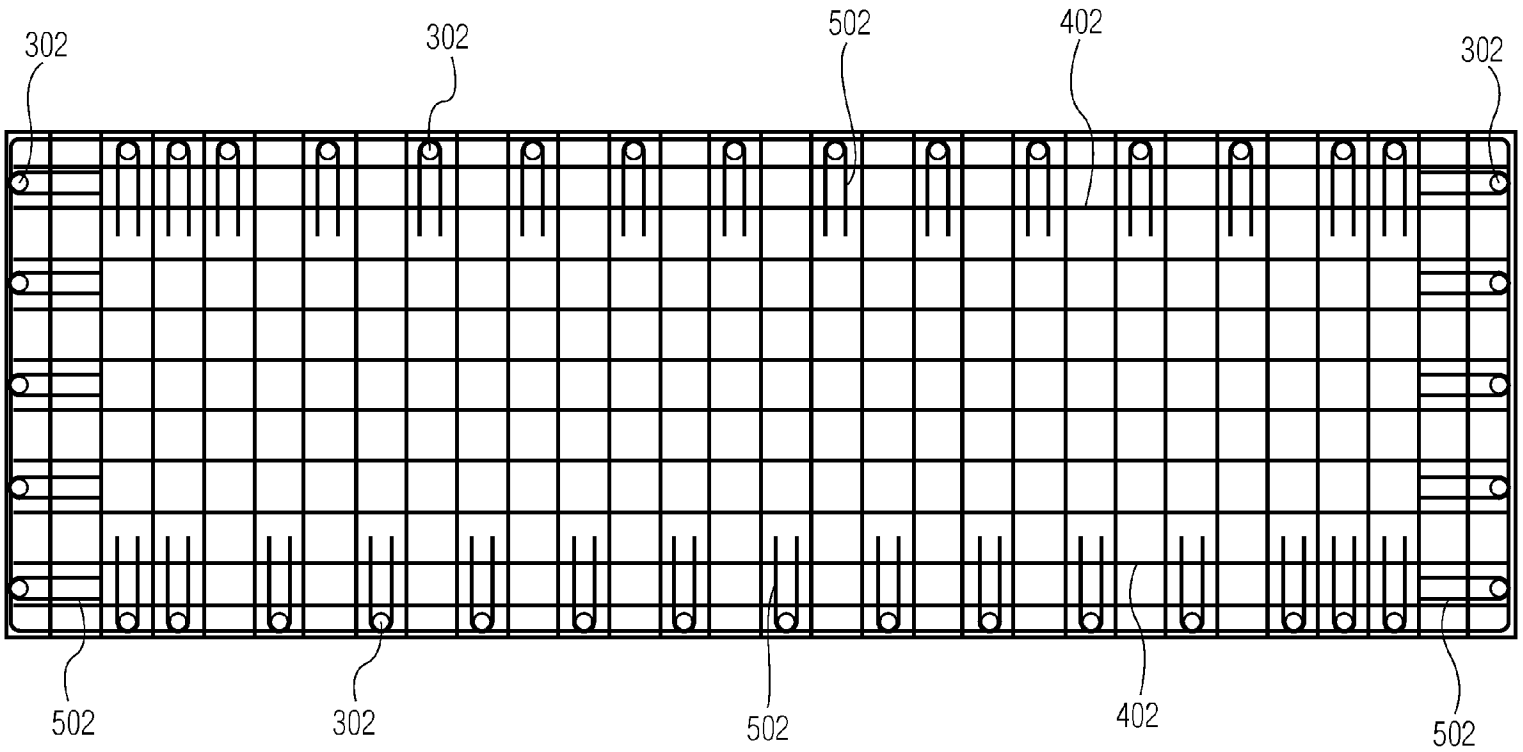
FIG. 5 depicts a plan view of an embodiment of a modular concrete deck platform.

FIG. 5 depicts a plan view of an embodiment of a modular concrete deck platform 202. The plan view depicts a structural grid pattern of reinforcing bar 402 within the concrete slab. The reinforcing bar 402 may be spaced appropriately to adequately reinforce the concrete slab. The concrete slab is formed around the reinforcing bar 402 making the reinforcing bar integral to the concrete slab. The plan view also depicts sleeve openings 302. The sleeve openings 302 allow for access to the beams 106 and girders 104 of a building frame through the modular concrete deck platforms 202. In some embodiments, the sleeve openings 302 may be spaced evenly in standardized increments along the perimeter of a modular concrete deck platform 202. In some embodiments, the sleeve openings 302 may be staggered in uneven increments. Some embodiments may have more or less sleeve openings 302 than are illustrated in FIG. 5. For example, in some embodiments, there may be only one sleeve opening 302 on each principal side of a modular concrete deck platform 202. In other embodiments, each principal side may have more than one sleeve opening 302. The number and location of sleeve openings 302 may vary depending on the design requirements of a particular building or other considerations. In some embodiments, each sleeve opening 302 will interface with shear connectors (described more fully below). Each sleeve opening 302 may interface with as few as one shear connector or as many as necessary to transfer the forces from the platform 202 to the structural frame.

Sleeve openings 302 may be of other shapes, sizes, or geometries. In the illustrated embodiment, the sleeve openings 302 are cylindrical openings free of concrete. In the illustrated embodiment, the sleeve openings 302 are circular and extend from a top major surface of the concrete slab to a bottom major surface of the concrete slab. In some embodiments, the sleeve openings 302 are corrugated with alternating ridges and grooves. For example, concrete may be formed around corrugated pipes (described in FIG. 6A) leaving corrugated sleeve openings 302 in the modular concrete deck platforms. Other shapes are envisioned. The size of the sleeve openings 302 may vary to allow access to the beams 106 and girders 104. In some embodiments, the sleeve openings 302 are five inches in diameter. The sleeve openings 302 are placed near enough to the perimeter of the modular concrete deck platforms 202 to expose beams 106 and girders 104 when the modular concrete deck platforms 202 are placed on the beams 106 and girders 104. In some embodiments, the sleeve openings 302 are placed at the perimeter of the platforms 202 with concrete surrounding the sleeve openings 302. The distance between the edge of the modular concrete deck platforms 202 and the sleeve openings 302 at the nearest point may be, for example, around one inch and as small as a half an inch although other distances are possible. In an embodiment, there is complete concrete coverage between the edge of a modular concrete deck platform and a sleeve at the nearest point between the edge of the modular concrete deck platform and the sleeve. In an embodiment, the thickness of concrete between the edge of a modular concrete deck platform and a sleeve at the nearest point between the edge of the modular concrete deck platform and the sleeve is dictated by relevant building codes, including structural engineering requirements of, for example, the American Concrete Institute (ACI) or the National Precast Concrete Association (NPCA). In some embodiments, the distance between the edge of the modular concrete deck platforms 202 and the sleeve openings 302 does not exceed half the width of beams 104 and girders 106. Within the sleeve openings, shear connectors may be placed after placing the modular concrete deck platform on beams. In some embodiments, the shear connectors are pins that are connected, attached, welded, or otherwise stabilized to the beams and are within the space of the sleeve openings 302.

The plan view of FIG. 5 depicts rebar loops 502 within the concrete slab. The rebar loops 502 are reinforcing bar that form around the sleeve openings 302 in the space between the sleeve openings 302 and the side edges of the modular concrete deck platforms 202. In some embodiments, the rebar loops 502 may be attached to the structural grid of reinforcing bar 402. For example, the rebar loops 502 may be welded, wire tied or wrapped around the reinforcing bar 402. In some embodiments, the rebar loops 502 are separate from the structural grid pattern of reinforcing bar 402. In some embodiments, the rebar loops 502 are integrated into or connected to the structural grid pattern of reinforcing bar 402.

Figure 6A:
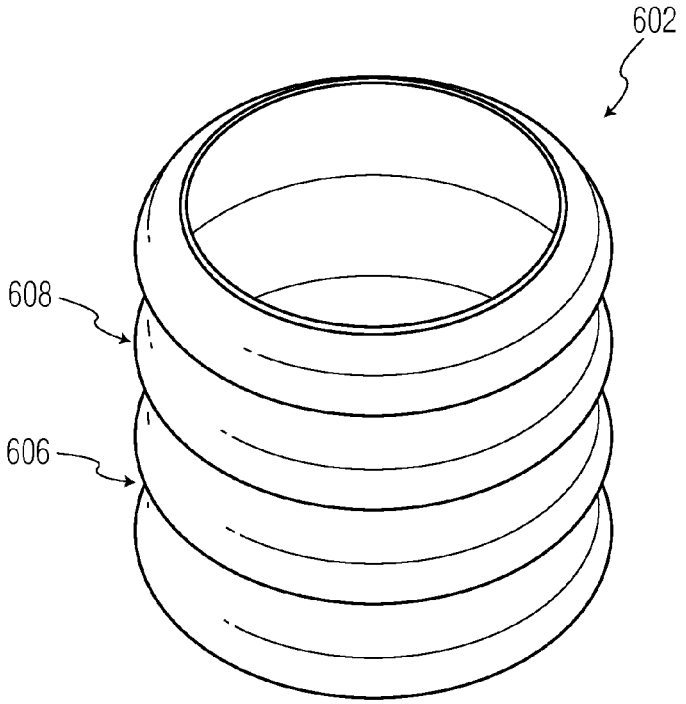
FIG. 6A depicts a perspective view of the corrugated sleeve.
Figure 6B:
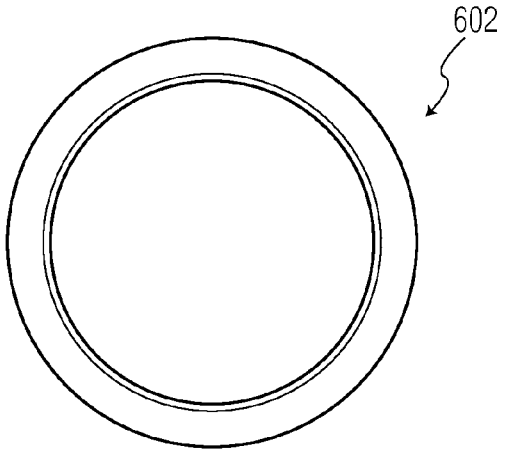
FIG. 6B depicts a top view of the corrugated sleeve of FIG. 5A.
Figure 6C:
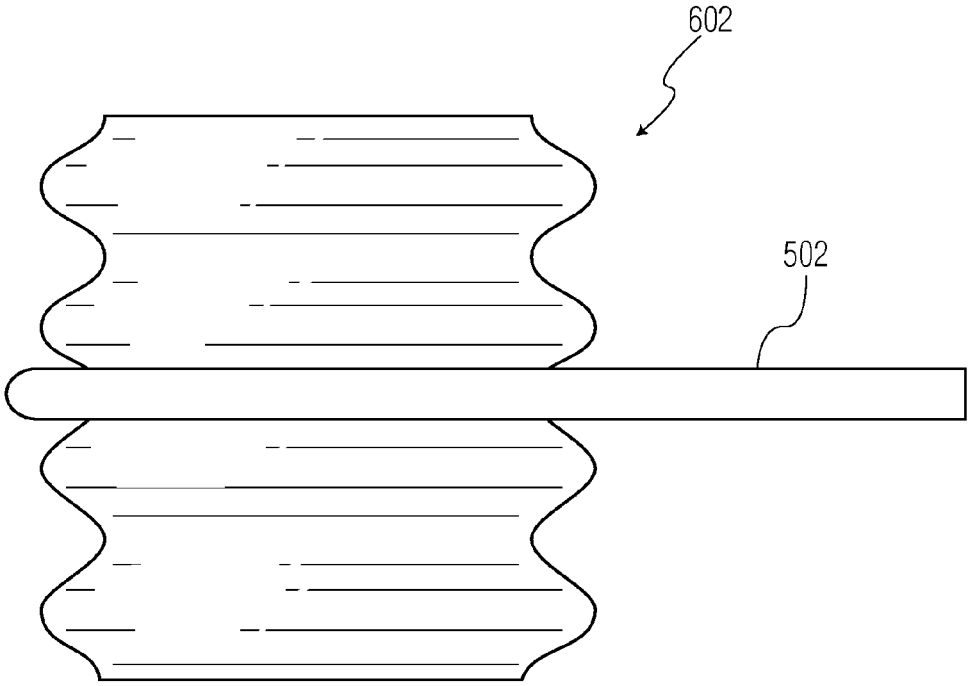
FIG. 6C depicts a side view of the corrugated sleeve.

FIGS. 6A-6C depict embodiments of a sleeve structure 602. In the illustrated embodiment, the sleeve structure 602 is a corrugated pipe. Concrete is formed around the sleeve structure 602 to create a sleeve opening 302 and the sleeve opening 302 is the space within the sleeve structure 602. In some embodiments, the sleeve structure 602 is a 5 inch steel corrugated pipe. The sleeve structure 602 may be of various sizes. For example, sleeves with diameter sizes of 4 inches to 12 inches and heights of 2 inches to 12 inches and shapes of circular, square, or rectangular are possible. Although the sleeve structure 602 is a corrugated pipe in the illustrated embodiment, the sleeve structure 602 may be of other shapes or sizes. For example, the sleeve structure 602 may be a cylinder. In addition, the sleeve structure 602 may be made of a material around which concrete can form leaving a sleeve opening 302. FIG. 6A depicts a perspective view of the corrugated sleeve structure 602 and FIG. 6B depicts a top view of the corrugated sleeve structure 602. The corrugated sleeve structure 602 has alternating ridges 608 and grooves 606. FIG. 6C depicts a side view of the corrugated sleeve structure 602 and depicts one embodiment of the interface between the corrugated sleeve structure 602 and a rebar loop 502, where the rebar loop 502 runs along a groove 608 of the corrugated sleeve structure 602. With the rebar loop 502 in the groove 608, the sleeve structure 602 may be placed closer to the perimeter edge of the modular concrete deck platform 202. The connections of the rebar and the rebar attachments are also variable. For example, the rebar loop 502 may be welded to the sleeves, wire tied to the sleeves, or even wrapped around the sleeves. The rebar loop 502 and the grooves 608 and ridges 606 may be of various sizes. The rebar loop 502 may be sized according to the building requirements. Standard rebar diameter sizes may run from ⅜" to 2¼". The grooves 608 of the sleeve structure 602 may be sized to correspond to the diameter of the rebar. In some embodiments, the grooves 608 may be smaller or larger than the rebar diameter.

Figure 7A:
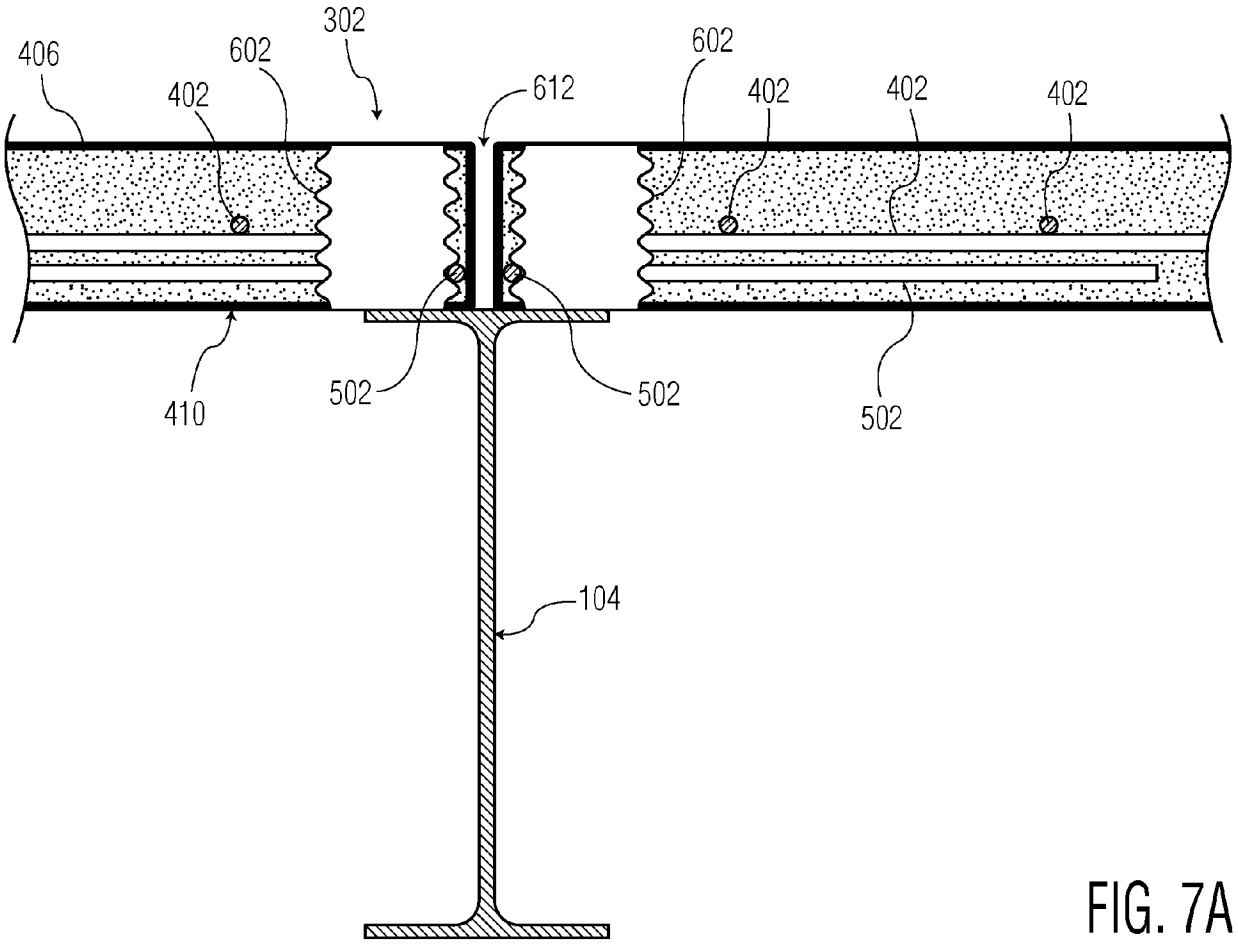
FIG. 7A depicts a cut-away view of an embodiment of modular concrete deck platforms placed on a girder.

FIGS. 7A-9 depict embodiments of modular concrete deck platforms placed on beams of the structural frame of a building. FIG. 7A depicts a cut-away view of an embodiment of modular concrete deck platforms placed on a girder 104. The illustrated embodiment depicts two modular concrete deck platforms 202 placed side by side on a girder 104. The illustrated embodiment further depicts a sleeve structure 602 within which is a sleeve opening 302. Each modular concrete deck platform includes reinforcing bar 402 throughout the concrete slab. Further depicted is the rebar loop 502 which loops around the sleeve structure 602. The sleeve openings 302 allow for access to the girder 104. Even when the modular concrete deck platforms 202 are placed on the girder 104, the sleeve openings 302 allow for access to the beams and/or girders 104. The girders 104 and beams 106 provide vertical support for the modular concrete deck platforms 202. The edge of the bottom surface of the modular concrete deck platform rests on the top surface of the girder 104. In the illustrated embodiment, the modular concrete deck platform is placed on about half of the top surface of the girder 104. This allows for the other half of the top surface of the girder 104 or beam 106 to support an adjacent modular concrete deck platform 202. In some embodiments, the modular concrete deck platforms 202 may be placed flush to adjacent modular concrete deck platforms 202. The illustrated embodiment of FIGS. 7A and 7B depicts a gap 612 between the modular concrete deck platforms 202. The gaps between adjacent modular concrete deck platforms 202 may be filled with a grout to form a continuous fire rated deck assembly.

In an embodiment, the modular concrete deck platforms 202 are fabricated with 5 inch diameter corrugated steel sleeve structures 602. In some embodiments, the sleeve structures 602 are spaced at about 24 inches along the perimeter of the concrete slab. In some embodiments, the corrugated sleeve structures 602 are spaced more or less than 24 inches apart. In some embodiments, the sleeve structures 602 are structures that have side walls that create a tube or channel structure and pathway completely through the concrete slab. That is, the sleeves create a pathway that is free of concrete from the top major surface of the concrete slab to the bottom major surface of the concrete slab. In some embodiments, the sleeve structures 602 are placed close to the perimeter while still having concrete on the side walls of the modular concrete deck platforms 202. In some embodiments, the sleeves are located about 1" from the outer edge of the perimeter of the concrete slab.

Figure 7B:
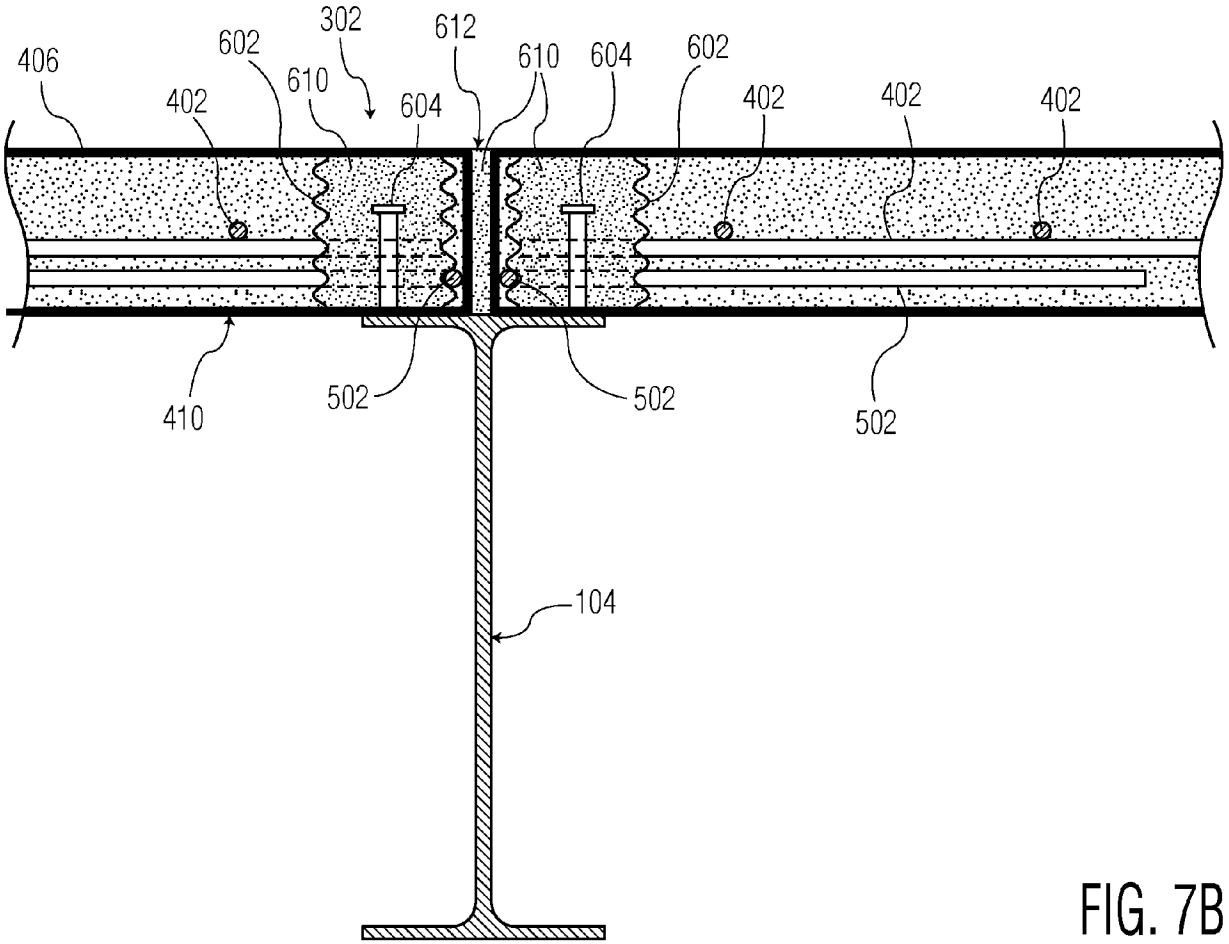
FIG. 7B depicts a cut-away view of the modular concrete deck platforms of FIG. 7A after placing the shear connectors.

FIG. 7B depicts a cut-away view of the modular concrete deck platforms 202 of FIG. 7A after the shear connectors 604 have been attached to the girder 104. After the modular concrete deck platform 202 is placed on the girder 104, and the shear connectors 604 are attached to the girder 104, the sleeve openings 302 and gaps 612 between adjacent modular concrete deck platforms 202 may be filled with grout 610. Grout 610 would also fill in the gap 612 between the two platforms 202. The illustrated embodiment of FIG. 7B depicts grout 610 within the sleeve openings 302 and in the gap 612. Grout 610 may be another material or substance that fills in the space within the sleeve openings 302. In some embodiments, the grout may be a concrete similar to the concrete of the concrete slab of the modular concrete deck platform 202. In some embodiments, the grout will be of strength equal to or greater than the strength of the concrete slab itself. In an embodiment, such grouting in the sleeve opening and between the platform pieces will complete the fire-rating requirement of the floor slab through the platform pieces and create a composite assembly for the structure.

Figure 8:
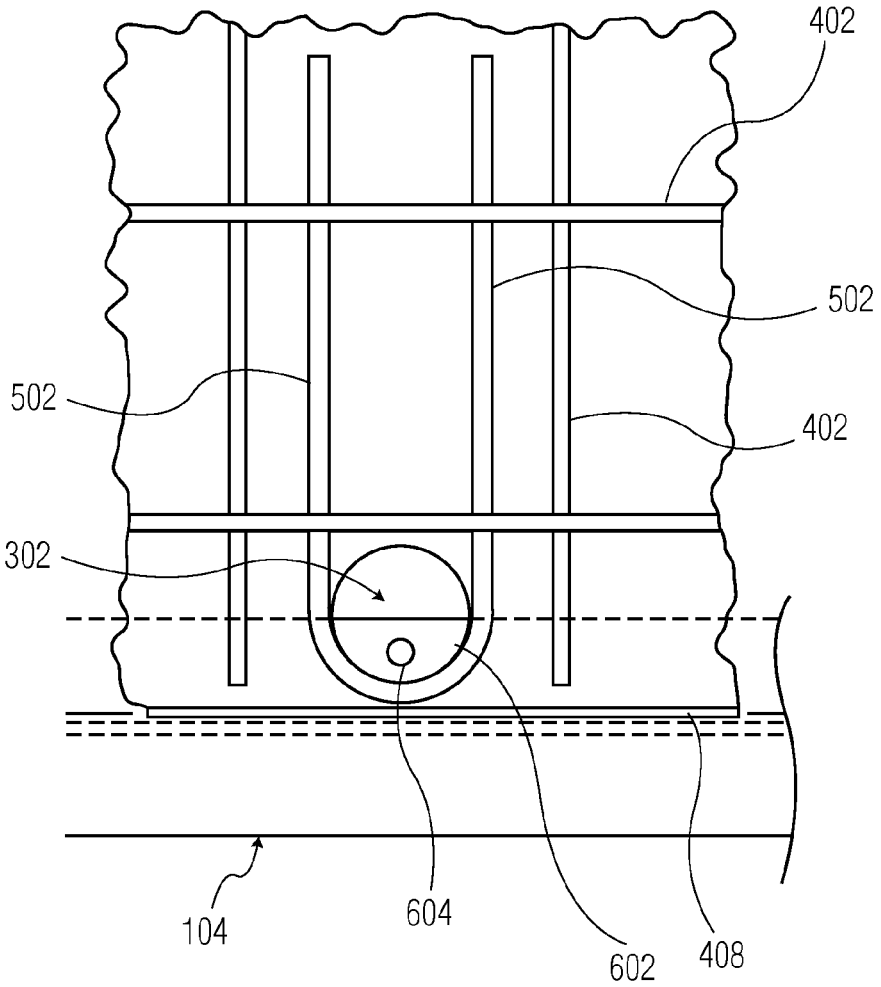
FIG. 8 depicts an embodiment of a plan view of the modular concrete deck platform with sleeve openings.

FIG. 8 depicts an embodiment of a plan view of a portion of a modular concrete deck platform with a sleeve opening 302. The illustrated embodiment depicts only one sleeve opening 302, which is able to expose the girder 104. After placement of the platform, a shear connector 604 may be fastened, welded, attached, or otherwise stabilized to the girder 104 to resist against shearing forces between the modular concrete deck platforms and the beams 106 and girders 104. The illustrated embodiment further depicts the grid of reinforcing bars 402 and the rebar loop 402.

In some embodiments, the shear connectors 604 are pins that are inserted into the sleeve openings 302 after the platforms 202 are placed on the beams 106 and girders 104 and then are welded to the beams 106 and girders 104. In an embodiment, it is advantageous to attach the pins only after placement of the platforms so that the beams and girders are free of pins until after the platforms are placed. Having the beams and girders free of pins until after the platforms are placed allows for workers to more easily navigate the beams and girders during construction of the building (e.g., because vertically projecting pins can be a tripping hazard). Additionally, in some jurisdictions, it is required by occupational safety law that shear connectors not be attached to the beams and girders until after decking has been placed.

In some embodiments, the shear connectors 604 are attached to the beams 106 and girders 104 before placing the modular concrete deck platform 202 on the beams 106 and girders 104. In some embodiments, the shear connectors 604 are protrusions on the beams 106 and girders 104 themselves.

The illustrated embodiment of FIG. 8 depicts a single pin or shear connector 604. In some embodiments, the number of shear connectors 604 placed within each sleeve opening 302 may be more or less than what is depicted. Embodiments may include the use of one or more shear connectors 604. Some embodiments may include the use of as few as one shear connector 604. Some embodiments may include as many shear connectors 604 as are needed to transfer forces from the platform 202 to the structural frame.

Figure 9:
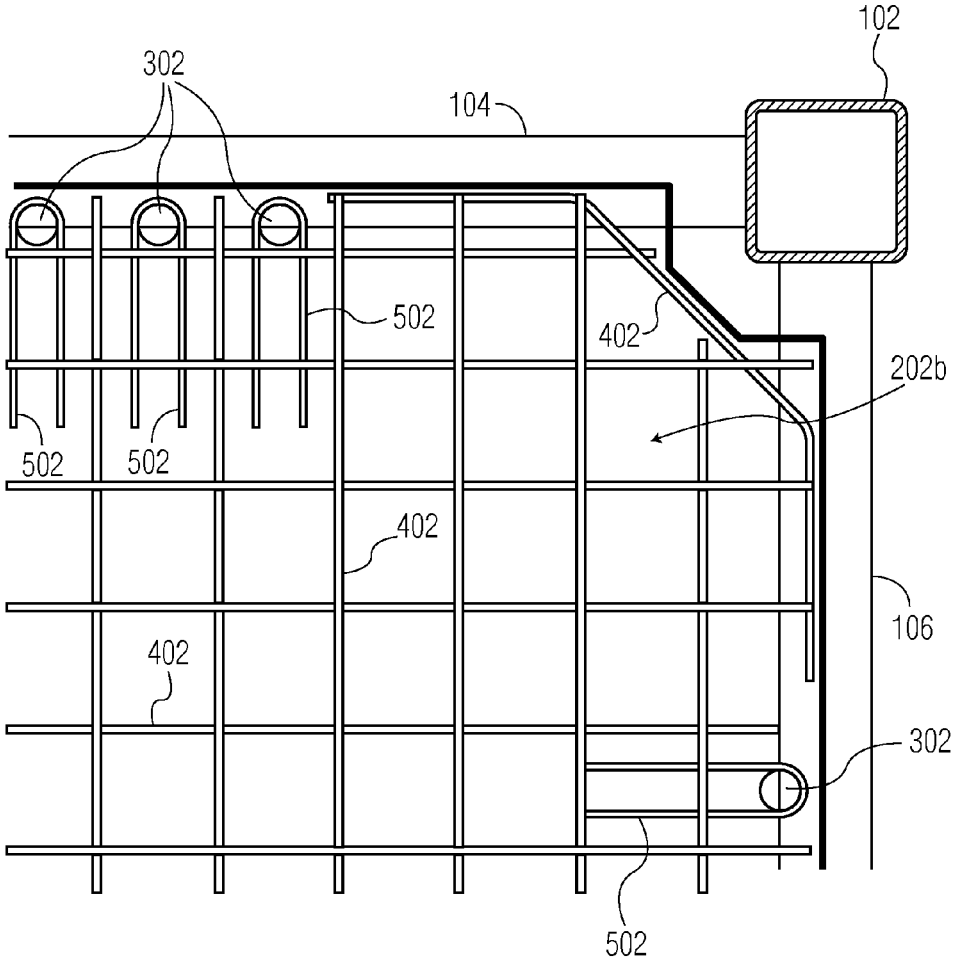
FIG. 9 depicts a partial plan view of an embodiment of a modular concrete deck platform as placed on the structural frame of a building.

FIG. 9 depicts a partial plan view of an embodiment of a modular concrete deck platform 202 as placed on the structural frame of a building. In the illustrated embodiment, the modular concrete deck platform is located to cover the bay of a building. The edges of the bottom major surface of the concrete slab rest on the horizontal I-beam or beam 106 and the girder 104. The sleeve openings 302 allow access to the beams or girders even when modular concrete deck platforms are placed side by side. The plan view depicts a structural grid pattern of reinforcing bar 402 within the concrete slab. The reinforcing bar 402 may be spaced appropriately to adequately reinforce the concrete slab.

Figure 10:
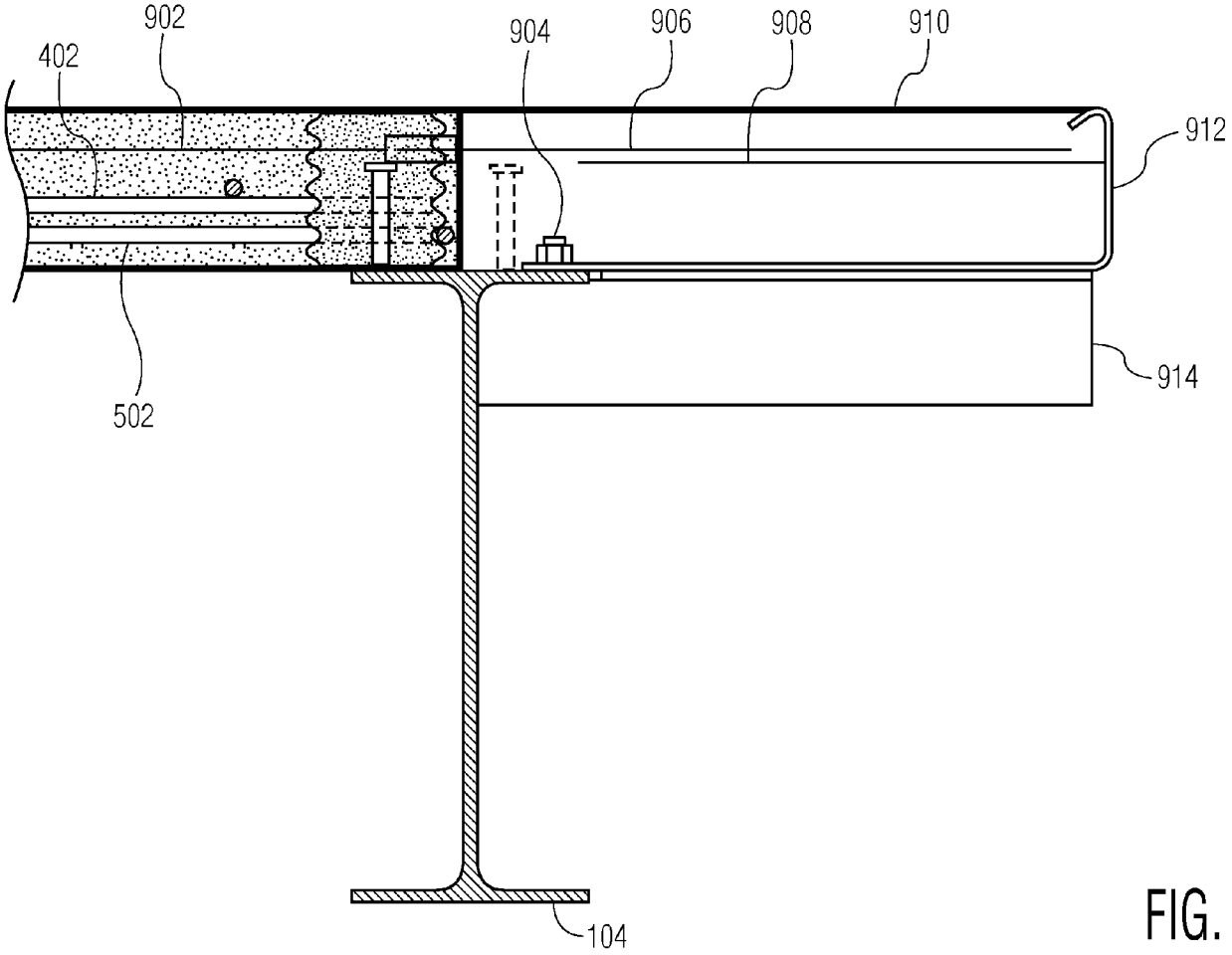
FIG. 10 depicts schematic of an embodiment of an edge of slab.

FIG. 10 depicts a schematic of an embodiment of an edge of slab. In an embodiment, the edge of slab is a conventional cast in place pour strip that is placed at the outer perimeter of a building (e.g., essentially overhanging the outermost beams and/or girders). In an embodiment, a bent plate 912 is provided along the perimeter that serves as a form for the cast-in-place concrete. The bent plate is supported by steel angles that are welded to the perimeter moment frame beam. Deformed bar anchors and inserts connect the pour strip to the adjacent precast slab to provide general structural integrity and additional capacity for façade attachment. The illustrated embodiment includes a straight bar dowel splicer 902, a welded threaded stud 904, a dowel-in anchor 906, a deformed bar anchor 908 a cast-in-place slab edge 910, a bent plate 912 and flange 914. This schematic could be modified as needed by the structural requirements of the building. In an embodiment, the edge of slab extends approximately from twelve inches to five feet beyond the outermost building column line of the corresponding structural beam or girder of the building.

Although the above-described embodiments of a modular concrete deck platform are provided as an example of the design of the modular concrete deck platform, it should be noted that certain aspects of the design can be modified without departing from its spirit or essential characteristics. For example, the size and shape of the sleeve structures 602 is variable. For example, sleeve structures 602 with diameter sizes of 4 inches to 12 inches and heights of 2 inches to 12 inches and shapes of circular, square, or rectangular are possible. The sleeve structures 602 provide a place to attach the modular concrete deck platforms 202 to the moment frames or gravity beams for lateral support and/or stability including seismic restraint or other restraint.

The connections of the rebar and the rebar attachments are also variable. For example, the rebar may be welded to the sleeves, wire tied to the sleeves, or even wrapped around the sleeves. The locations of the sleeves and the quantities of the sleeves are also variable. For example, the locations of the sleeves may be evenly spaced along the sides of the concrete slabs or spaced unevenly. There may be areas near columns that have no sleeves and other areas along the perimeter of the slab where the sleeves are more concentrated. The number of sleeves around the perimeter of a concrete slab may be, for example, from 1 to 100 along the side of a concrete slab depending on the length of the side and/or the requirements to satisfy the forces that may act upon the slab. In some embodiments, the sleeve openings are spaced 24 inches apart. There may be no sleeve openings in protected zones on the moment frame beam near columns. This may result in clusters of sleeve openings near and adjacent to the protected zones. In an embodiment, the sleeves are made of steel although other materials that provide the necessary structural support may be used.

In an embodiment, the modular concrete deck platform 202 can be configured to include features that produce a fire rated deck assembly to provide the required fire separation based on the use of the building. In an embodiment, the thickness of the concrete deck platform is dictated by the relevant building codes, structural engineering requirements as well as best practices of the ACI or NPCA. With respect to fire rating, the number of hours of fire protection provided by a concrete deck is a function of the properties (e.g., thickness and materials of construction) of the concrete deck. In an embodiment, the modular concrete deck platform is configured such that the platform meets or exceeds applicable building codes. For example, the concrete deck platform is configured to meet local, state, and/or federal building codes.

Figure 11:
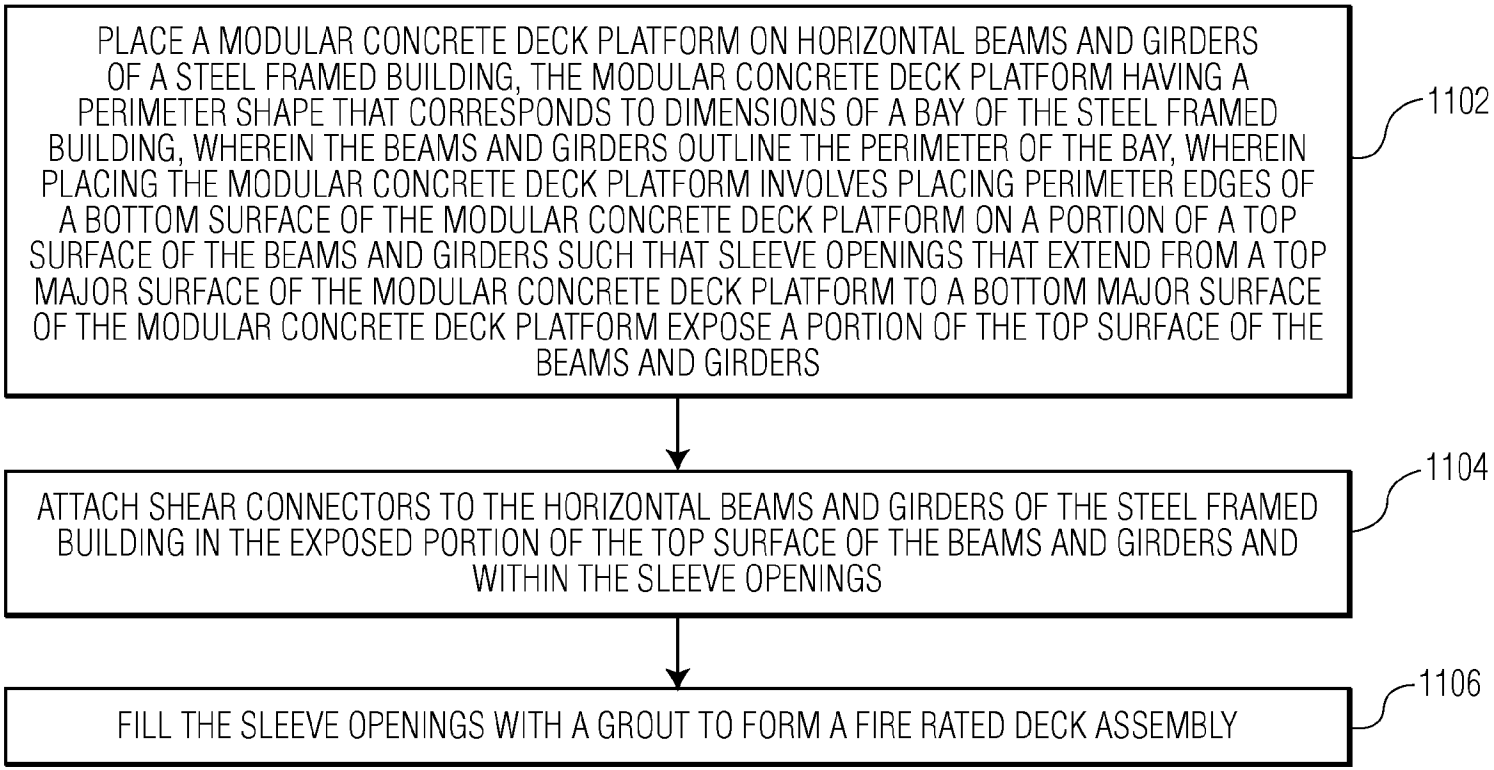
FIG. 11 is a process flow diagram of a method for constructing a floor in a steel framed building.

FIG. 11 is a process flow diagram of a method for constructing a floor in a steel framed building. The method involves, at block 1102, placing a modular concrete deck platform on horizontal beams and girders of a steel framed building, the modular concrete deck platform having a perimeter shape that corresponds to dimensions of a bay of the steel framed building, wherein the beams and girders outline the perimeter of the bay. Additionally, placing the modular concrete deck platform involves placing perimeter edges of a bottom surface of the modular concrete deck platform on a portion of a top surface of the beams and girders such that sleeve openings that extend from a top major surface of the modular concrete deck platform to a bottom major surface of the modular concrete deck platform expose a portion of the top surface of the beams and girders. At block 1104, after placing the modular concrete deck platform, shear connectors are attached to the horizontal beams and girders of the steel framed building in the exposed portion of the top surface of the beams and girders and within the sleeve openings. At block 1106, after attaching the shear connectors to the horizontal beams and girders of the steel framed building, the sleeve openings are filled with a grout to form a fire rated deck assembly. In an embodiment, if there are gaps between the decks (such as gaps 612, FIGS. 7A and 7B), then the gaps may also be filled with a grout to form the fire rated deck assembly.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A steel framed building comprising:

a structural frame defining a footprint of the steel framed building, the structural frame comprising vertical columns and horizontal beams and girders, wherein the horizontal beams and girders define bays within the steel framed building;

modular concrete deck platforms located on the horizontal beams and girders of the structural frame, the modular concrete deck platforms comprising:

a concrete slab having a top major surface and a bottom major surface;

a structural grid pattern of reinforcing bar within the concrete slab;

sleeve openings located at a perimeter of the top major surface of the concrete slab, the sleeve openings surrounded by sleeve structures, the sleeve structures entirely surrounded by concrete such that there is complete concrete coverage between the edge of a modular concrete deck platform and a sleeve at the nearest point between the edge of the modular concrete deck platform and the sleeve;

wherein each sleeve opening extends from the top major surface of the concrete slab to the bottom major surface of the concrete slab;

wherein the modular concrete deck platforms are vertically supported on edges of the modular concrete deck platforms by the horizontal beams and girders of the steel framed building;

wherein the modular concrete deck platforms have a perimeter shape that corresponds to dimensions of a bay of the steel framed building, and wherein the sleeve openings expose a portion of a horizontal beam or girder of the steel framed building;

wherein shear connectors are attached to a horizontal beam or girder of the steel framed building within the sleeve openings;

wherein the sleeve openings are filled with grout;

wherein each sleeve structure comprises a corrugated sleeve comprising ridges, and wherein the modular concrete deck platform further comprises a rebar loop between the sleeve structure and side surface of the concrete slab, wherein the rebar loop aligns between the ridges of a corresponding corrugated sleeve and within a groove of the corrugated sleeve.

2. The steel framed building of claim 1, wherein the modular concrete deck platforms have a perimeter shape that corresponds to dimensions of a bay of the steel framed building, wherein the bay is a location in the steel framed building that includes a vertical support column and wherein the perimeter shape copes at least partially around the vertical support column, and wherein the sleeve openings expose a portion of a horizontal beam or girder of the steel framed building.

3. The steel framed building of claim 1, wherein the modular concrete deck platforms have a perimeter shape that corresponds to dimensions of a bay of the steel framed building, wherein the bay is a location in the steel frame building that does not include a vertical support column and wherein the perimeter shape is rectangular, and wherein the sleeve openings expose a beam or girder of the steel framed building.

4. The steel framed building of claim 1, wherein the sleeve structures comprise corrugated steel sleeves.

5. A method for constructing a floor in a steel framed building, the method comprising:

placing a modular concrete deck platform on horizontal beams and girders of a steel framed building, the modular concrete deck platform having a perimeter shape that corresponds to dimensions of a bay of the steel framed building, wherein the horizontal beams and girders outline the perimeter of the bay, wherein placing the modular concrete deck platform comprises placing perimeter edges of a bottom surface of the modular concrete deck platform on a portion of a top surface of the horizontal beams and girders, and wherein sleeve openings that extend from a top major surface of the modular concrete deck platform to a bottom major surface of the modular concrete deck platform expose a portion of the top surface of the horizontal beams and girders; and after placing the modular concrete deck platform, attaching shear connectors to the horizontal beams and girders of the steel framed building in the exposed portion of the top surface of the horizontal beams and girders and within the sleeve openings.

6. The method of claim 5, the method further comprising filling the sleeve openings with a grout after attaching the shear connectors to the horizontal beams and girders of the steel framed building to form a fire rated deck assembly.

7. The method of claim 5, the method further comprising placing a second modular concrete deck platform adjacent to the modular concrete deck platform, wherein the placing the second modular concrete deck platform comprises placing perimeter edges of a bottom surface of the second modular concrete deck platform on a portion of a top surface of the horizontal beams and girders, wherein an edge of the modular concrete deck platform and an edge of the second modular concrete deck platform each rest on portions of the same beam.

8. The method of claim 7 further comprising filling any gaps between the modular concrete deck platform and the second modular concrete deck platform with grout.

* * * * *